US010895222B2

(12) United States Patent
Habu et al.

(10) Patent No.: US 10,895,222 B2
(45) Date of Patent: Jan. 19, 2021

(54) FLOW CONTROL VALVE FOR CHARGE FORMING DEVICE

(71) Applicant: Walbro LLC, Tucson, AZ (US)

(72) Inventors: Katsushi Habu, Natori (JP); Tomoya Kawada, Sendai (JP); Kazuya Sasahara, Igu-gun (JP)

(73) Assignee: Walbro LLC, Tucson, AZ (US)

( * ) Notice: Subject to any disclaimer, the term of this patent is extended or adjusted under 35 U.S.C. 154(b) by 0 days.

(21) Appl. No.: 16/395,436

(22) Filed: Apr. 26, 2019

(65) Prior Publication Data

US 2019/0360432 A1 Nov. 28, 2019

Related U.S. Application Data

(60) Provisional application No. 62/674,710, filed on May 22, 2018.

(51) Int. Cl.

| | |
|---|---|
| ***F02M 7/18*** | (2006.01) |
| ***F02M 7/24*** | (2006.01) |
| ***F02M 17/04*** | (2006.01) |
| ***F02M 9/08*** | (2006.01) |

(52) U.S. Cl.

CPC ..... *F02M 7/18* (2013.01); *F02M 7/24* (2013.01); *F02M 9/085* (2013.01); *F02M 17/04* (2013.01)

(58) Field of Classification Search

CPC ..... F02M 7/18; F02M 7/24; F02M 9/085; F02M 17/04

See application file for complete search history.

(56) References Cited

U.S. PATENT DOCUMENTS

| | | | | |
|---|---|---|---|---|
| 4,759,883 | A | 7/1988 | Woody et al. | |
| 7,287,743 | B1 | 10/2007 | Gliniecki | |
| 10,054,082 | B2 * | 8/2018 | King | F02M 17/04 |
| 2018/0238456 | A1 * | 8/2018 | Farquharson | F16K 3/0236 |
| 2019/0145352 | A1 * | 5/2019 | Kawada | F02M 21/023 251/359 |

* cited by examiner

*Primary Examiner* — Hieu T Vo
(74) *Attorney, Agent, or Firm* — Reising Ethington P.C.

(57) ABSTRACT

A charge forming device includes a body with a main bore through which air flows and a fuel inlet through which fuel enters the main bore. A diaphragm defines part of a fuel chamber that leads to a fuel passage. The valve body is received in the fuel passage and has a first end, a second end, a sidewall, a valve passage having an inlet into which fuel from the fuel chamber enters and an outlet from which fuel exits for delivery to the main bore, and a cross passage extending through the sidewall between the first end and the second end and opening into the valve passage. A valve is carried by the body and has a valve head received in the cross passage and extending into the valve passage to at least partially inhibit fuel flow through the valve passage.

19 Claims, 4 Drawing Sheets

FLOW CONTROL VALVE FOR CHARGE FORMING DEVICE

REFERENCE TO RELATED APPLICATIONS

This application claims the benefit of U.S. Provisional Application Ser. No. 62/674,710 filed on May 22, 2018, the entire contents of which is incorporated herein by reference in its entirety.

TECHNICAL FIELD

The present disclosure relates generally to a flow control valve for a charge forming device.

BACKGROUND

Carburetors provide a mixture of fuel and air to an engine to support combustion in and operation of the engine. The fuel flow rate may be relatively low at low engine speeds in smaller engines, and the fuel flow rate may need to quickly vary to support high engine acceleration or increased engine power demand. Fuel flow paths in a carburetor may be defined by drilled or cast passages and may be tortuous or convoluted requiring fuel to flow around corners and over a relatively long linear distance.

SUMMARY

In at least some implementations, a charge forming device includes a body, a diaphragm, a fuel metering assembly, a fuel passage, a valve body and a valve. The body has a main bore through which air flows and at least one fuel inlet through which fuel enters the main bore. The diaphragm is coupled to the body and defines part of a fuel chamber of a fuel metering assembly. An outlet of the fuel chamber leads to a fuel passage that extends from the outlet to the main bore. The valve body is received in the fuel passage and has a first end, a second end aligned with the first end, a sidewall extending between the first and second ends, a valve passage having an inlet into which fuel from the fuel chamber enters the valve passage and an outlet from which fuel exits from the valve passage for delivery to the main bore, and a cross passage extending through the sidewall between the first end and the second end and opening into the valve passage. The valve is carried by the body and has a valve head received in the cross passage and extending into the valve passage to at least partially inhibit fuel flow through the valve passage, and the valve head is movable relative to the valve body to vary the flow rate of fuel discharged from the valve body.

In at least some implementations, the fuel passage is linear. In at least some implementations, at least part of the fuel passage extends from the valve passage to the main bore without including a turn or deviation from a straight path by more than 20 degrees, measured from a center of the fuel passage.

In at least some implementations, the valve passage is arranged so that a straight line may be drawn within the valve passage between the first end and the second end without intersecting a portion of the valve body. A flow area of the valve passage may decrease continuously from the first end to the cross passage. A flow area of the valve passage decreases continuously from the second end to the cross passage. In at least some implementations, fluid flows through the valve passage from the first end to the second end, a flow area of the valve passage decreases from the first end to the cross passage, and the flow area of the valve passage increases from the cross passage to the second end. In at least some implementations, a minimum flow area of the valve passage is defined between the valve head and the valve body.

The cross passage may include an entrance that extends through the sidewall, and the valve body may include a cavity aligned with and facing the cross passage, and the cavity may be diametrically opposed to the entrance of the cross passage. In at least some implementations, the cross passage is perpendicular to the direction of fuel flow through the valve passage.

In at least some implementations, the body also includes a valve bore that intersects the main bore, and a throttle valve is rotatably received at least partially within the valve bore and includes a valve passage through which air from the main bore may flow. A fuel nozzle may be provided in communication with or defining part of the fuel passage and through which fuel is discharged into the main bore, and the valve passage may be aligned with the fuel nozzle such that a straight line may be drawn from the inlet of the valve passage, through the outlet of the valve passage and to a passage through the fuel nozzle.

In at least some implementations, a device for controlling fluid flow includes a valve body having a first end, a second end and a sidewall extending between the first end and the second end, a valve passage extending through the body from the first end to the second end such that a straight line may be drawn within the valve passage between the first end and the second end, and a cross passage extending through the sidewall between the first end and the second end and intersecting the valve passage. In at least some implementations, a flow area of the valve passage decreases from the first end to the cross passage. In at least some implementations, a flow area of the valve passage decreases from the second end to the cross passage. Fluid may flow through the valve passage from the first end to the second end, a flow area of the valve passage may decrease from the first end to the cross passage, and the flow area of the valve passage may increase from the cross passage to the second end.

In at least some implementations, a valve head is received in the cross passage and extending into the valve passage, and a minimum flow area of the valve passage is defined between part of the valve head and the valve body. The cross passage may include an entrance that extends through the sidewall, and the valve body may include a cavity aligned with and facing the cross passage, and the cavity may be diametrically opposed to the entrance of the cross passage. The cross passage may be perpendicular to the direction of fuel flow through the valve passage. In at least some implementations, a valve body is received in the cross passage and extends into the valve passage, and a minimum flow area of the valve passage is defined between part of the needle and the valve body.

BRIEF DESCRIPTION OF THE DRAWINGS

The following detailed description of certain embodiments and best mode will be set forth with reference to the accompanying drawings, in which.

DETAILED DESCRIPTION

Figure 1:
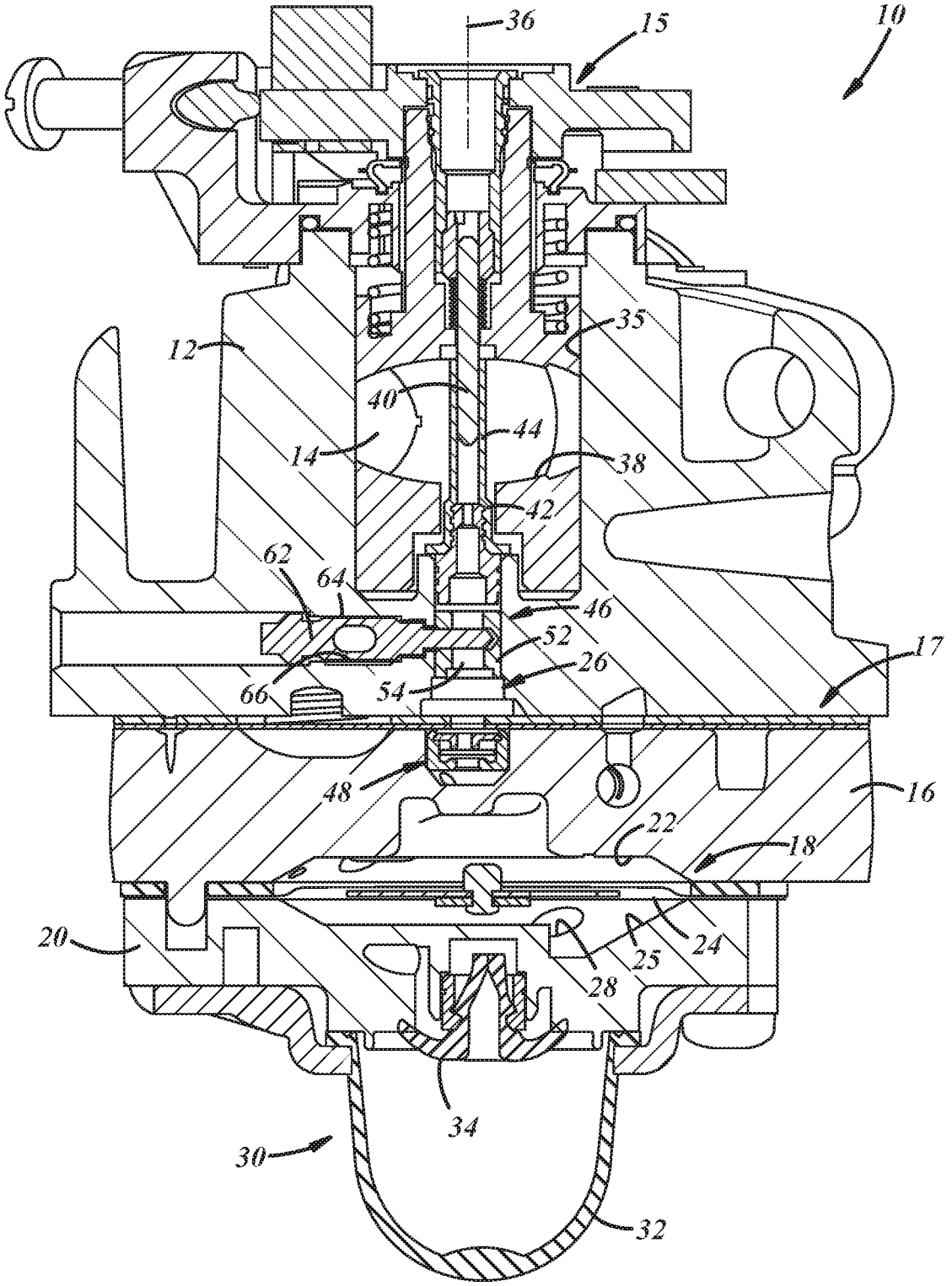
FIG. 1 is a cross-sectional view of a carburetor including a flow control valve in a fuel passage to a main bore of the carburetor.

Referring in more detail to the drawings, FIG. 1 illustrates a carburetor 10. The carburetor 10 is one embodiment of a charge forming device and provides a fuel and air mixture to an engine to support operation of the engine. The carburetor 10 includes a carburetor main body 12 having a main bore 14 through which air flows and into which fuel is supplied to be mixed with the air to provide the fuel and air mixture to the engine. The charge forming device is shown as being a diaphragm carburetor 10 that has a rotary throttle valve 15 but could instead include a butterfly type throttle valve and may be a throttle body or a float bowl type carburetor.

In more detail, the carburetor 10 includes a diaphragm fuel pump assembly 17 arranged between the main body 12 and an intermediate body 16 coupled to the main body 12. The fuel pump assembly may be constructed and arranged in a known manner to take fuel into the carburetor 10 and supply fuel to a fuel metering assembly 18 arranged between the intermediate body 16 and a cover plate 20. The fuel metering assembly 18 has an inlet valve (not shown) that controls the flow of fuel into a fuel chamber 22 that is defined by the intermediate plate 20 and a fuel metering diaphragm 24. A reference chamber 25 may be defined between the opposite side of the metering diaphragm 24 and the cover plate 20, and may be communicated with the atmosphere by a vent passage 28, if desired, or coupled to a different pressure source. The inlet valve is actuated by movement of the metering diaphragm 24 in response to pressure differentials across the metering diaphragm 24 to admit fuel into the fuel chamber 22. The fuel chamber 22 is communicated with a fuel passage 26 that extends to the main bore 14 through the intermediate body 16 and part of the main body 12. A purge and prime assembly 30 having a manually actuated bulb 32 and a two-way check valve 34 may be carried by the cover plate 20, if desired. The purge and prime assembly 30 may be constructed and arranged and operates in a known manner and will not be described further.

Fuel and air flow through the carburetor 10 is controlled by the rotary throttle valve 15. To receive the throttle valve 15, the main body 12 includes a valve bore 35 (FIGS. 1 and 2) extending perpendicular to and communicated with (e.g. intersecting) the main bore 14. The throttle valve 15 is rotatable about an axis 36 and axially movably received in the valve bore 35 and includes a throttle valve passage 38 therethrough that is variably aligned or registered with the main bore 14 as the throttle valve 15 is rotated to selectively open and close the main bore 14. As shown in FIG. 1, to vary the fuel flow in and from the carburetor, the throttle valve 15 may carry a needle 40. The needle 40 may project downward into the throttle valve passage 38 and have a distal or free end that is received in a main fuel nozzle 42.

The main fuel nozzle 42 may be carried by the main body 12 and may have a fuel outlet 44 that is, in at least some positions of the throttle valve 15, at least partially blocked by the needle 40. The fuel outlet 44 defines a fuel inlet for the main bore 14 in that fuel enters the main bore 14 from the fuel outlet 44. More than one fuel inlet may be provided for fuel flow into the main bore 14, in other implementations, such as is known in the art with regard to, for example, carburetors having butterfly type throttle valves. As the throttle valve 15 rotates and moves vertically within the valve bore 35, the needle 40 moves with the throttle valve 15 and slides axially within the main fuel nozzle 42 thereby adjusting or changing the size or flow area of the fuel outlet 44. In addition, rotation of the throttle valve 15 adjusts the degree or extent of communication between the main bore 14 and the valve passage 35 directly effecting the amount of air flow through the main bore 14. Generally, the higher the vertical position of the throttle valve 15, the greater the airflow through the main bore 14, the larger the fuel outlet flow area, and the greater the fuel flow into the valve passage 35 and out of the main bore 14 for delivery to the engine.

Figure 2:
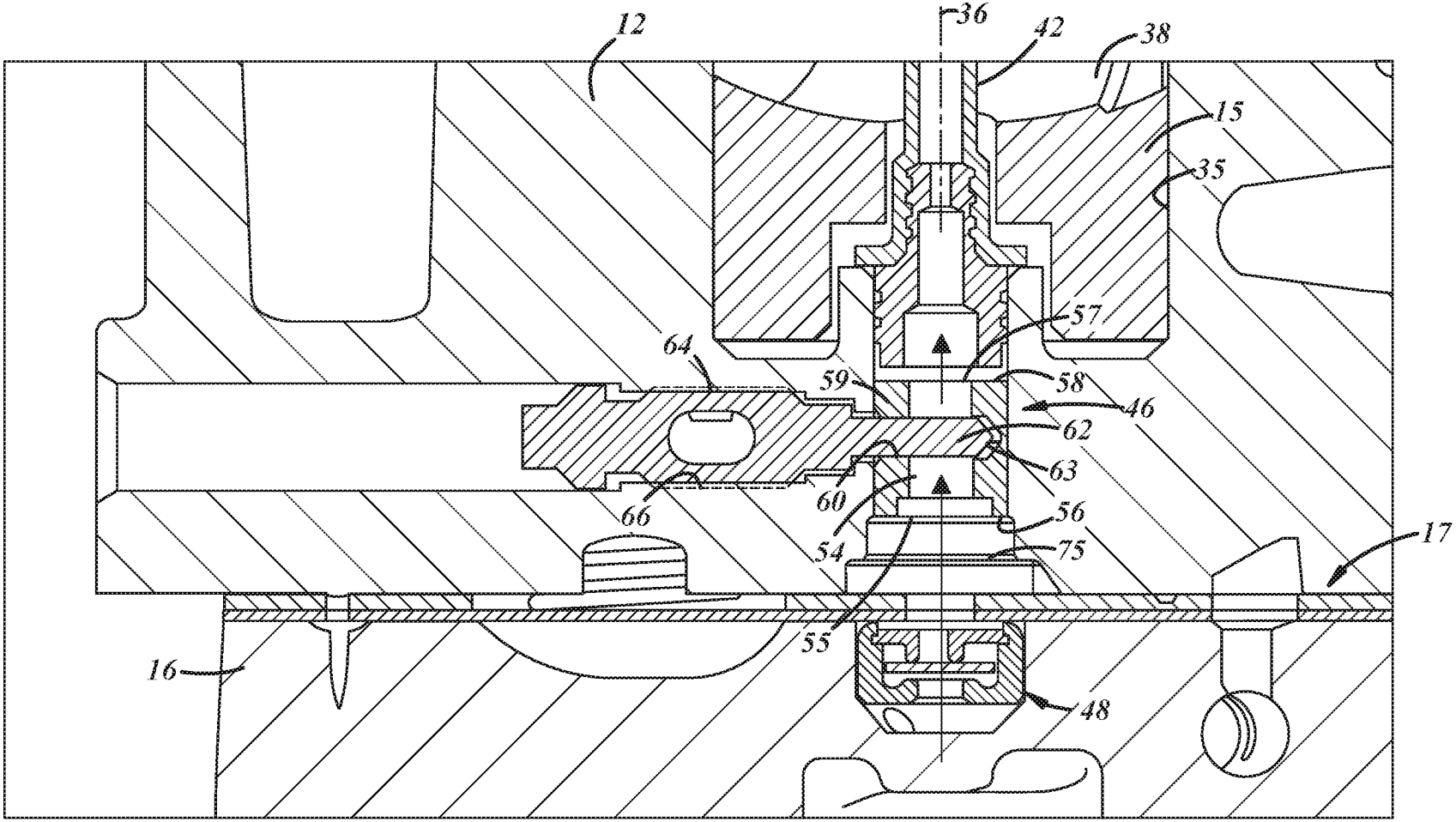
FIG. 2 is an enlarged cross-sectional view of a portion of the carburetor of FIG. 1.

As noted above, fuel is routed from the metering assembly fuel chamber 22 to the main bore 14 through the fuel passage 26. As shown in FIGS. 1 and 2, a flow control valve 46 may be received in the fuel passage 26 to permit adjustment of the fuel flow through the fuel passage 26. A check valve 48 may also be provided between an outlet of the fuel chamber 22 and the flow control valve 46 to permit fuel flow out of the fuel chamber 22 and into the fuel passage 26 but prevent the reverse flow of fuel from the fuel passage 26 into the fuel chamber 22. The flow control valve 46 includes a valve body 52 that is shown separately from the carburetor in FIGS. 3-7. The valve body 52 has an outer surface 53 that may have a size and shape to be closely received in part of the fuel passage 26 so that little or no fuel flows between the valve body 52 and the main body 12 (or intermediate body 16 if the flow control valve 46 is carried at least partially by the intermediate body). Instead, fuel must flow through a valve passage 54 that is formed through the valve body 52 from an inlet 55 at a first end 56 of the valve body 52 to an outlet 57 at a second end 58 of the valve body 52. A recess 51 (see e.g. FIGS. 4 and 6) may be provided in an outer surface 53 of a sidewall 59 of the valve body 52, and may receive a seal between the sidewall 59 and the main body 12 in the fuel passage 26 to inhibit or prevent fuel from leaking therebetween.

Figure 8:
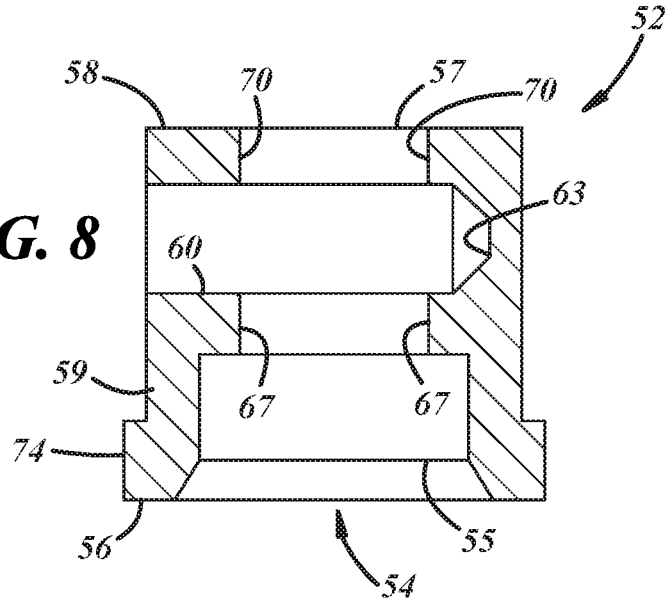
FIG. 8 is a cross-sectional view of a valve body taken generally along line 8-8 in FIG. 3.

In addition to the valve passage 54, the flow control valve 46 may include a cross passage 60 that intersects the valve passage 54 and extends through the outer surface 53 of the valve body 52. The cross passage 60 is arranged to receive a valve head 62 that is movable relative to the valve body 52 and the valve passage 54 to vary the open flow area of the valve passage 54 by blocking a portion of the valve passage 54 to vary the flow rate of fuel through the valve passage 54. In at least some implementations, the cross passage 60 is defined by an opening through the sidewall 59 of the valve body 52 and is spaced from either end 56, 58 of the valve passage 54, creating first and second portions of the valve passage 54 on opposite sides of the cross passage 60 as shown in FIGS. 1, 2, 4 and 8 (where FIG. 8 shows a slightly modified valve body having the cross passage 60 closer to the outlet end). The cross passage 60 may but need not extend through the valve body 52 such that the valve head may extend fully through the valve body 52. Instead, as shown in FIG. 2, the cross passage 60 may terminate within the valve body 52, that is, not extend through diametrically or otherwise opposed sides of the valve body 52. In the embodiment shown, the cross passage 60 extends through the sidewall 59 of the flow control valve 46 at a substantially perpendicular angle (i.e., within plus or minus five degrees of perpendicular) to the central axis 36 of the flow control valve 46 between the first end 56 and the second end 58 of the flow control valve 46. However, that the cross passage 60 may be arranged at other angles and still permit adjustment of the flow area of the valve passage 54 when the valve head 62 is moved relative to the valve body 52.

In the implementation shown, the valve head 62 includes a threaded portion 64 that is received in a threaded bore 66 in the main body 12 that intersects with the fuel passage 26 and is aligned with the cross passage 60. Thus, the valve head 62 may be axially moved relative to the valve body 52 by rotating the valve head 62. In at least some implementations, the portion of the valve head 62 received in the cross passage 60 has a diameter that is substantially (i.e., within 5%) the same size as the diameter of the cross passage 60 so that little or no fuel flows between the valve head 62 and the valve body 52 through the cross passage 60. A seal may be trapped between the valve body 52 and the main body 12 in the bore 66 or in the recess 51 formed in the valve body 52, and the valve head 62 may extend through the seal to prevent fuel from leaking from the fuel passage 26. Because at least some fuel flow is needed to permit operation of the engine, the valve head 62 typically will not extend fully across the valve passage 54, although as shown in FIG. 2, it could. FIGS. 2 and 8 show a cavity 63 in an inner surface of the valve body 52 opposite the entrance of the cross passage 60, and in FIG. 2 a free end of the valve head 62 is received partially in the cavity. Even in this position, fuel may flow around the periphery of the valve head 62 between the valve head 62 and valve body 52, from the first portion to the second portion of the valve passage 54.

The first portion of the valve passage 54 includes the inlet 55 through which fuel enters the valve body 52 and extends to the cross passage 60. The second portion of the valve passage 54 extends from the cross passage 60 to the outlet 57. The first portion and second portion may have the same size and shape, or they may be different. Further, the cross-sectional flow areas of the first and second portions may be the same or they may be different. In the implementation shown in the drawings, the first portion and second portion are mirror images of each other. The first portion converges, that is, has a smaller flow area at the intersection with the cross passage 60 than at the inlet 55. And the second portion diverges, that is, has a smaller flow area at the intersection with the cross passage 60 than at the outlet 57. The flow areas of both the first and second portions may change uniformly and continuously (e.g. a linear taper) or may change in any other desired manner to achieve a desired fuel flow through the valve body 52.

In more detail, in the embodiment shown, the first portion of the valve passage 54 is defined by portions of the sidewall 59 of the valve body 52, where the portions extend between the inlet 55 and the cross passage 60. A first pair of walls 65 define opposite sides of the first portion of the valve passage 54 and are angled toward each other (e.g., forming an acute angle relative to one another) from the inlet 55 to the cross passage 60. A second pair 67 of opposed walls are substantially parallel (i.e., within plus or minus five degrees of parallel) to one another, define opposite sides of the first portion and are joined to the other walls 65. However, it is appreciated that other valve passage 54 shapes (e.g., cylindrical, conical, quadrilateral prism, etc.) and other wall angles may also be used. For example, some embodiments may include one or more curved walls, the same flow area throughout the second portion of the valve passage 54 or the flow area may change in a different manner, and while the walls 65 are shown as being inclined at an angle $\alpha$ (FIG. 7) of about 60 degrees (e.g. each wall is inclined about 30 degrees from the axis 36), other embodiments may have walls at angles between 45 and 75 degrees relative to each other.

Figure 5:
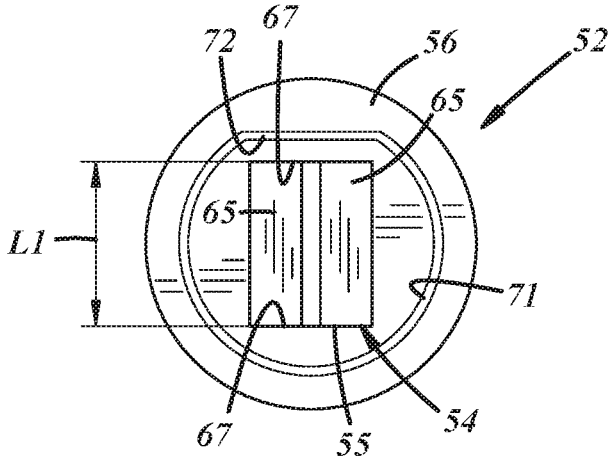
FIG. 5 is a bottom view of the valve body.
Figure 6:
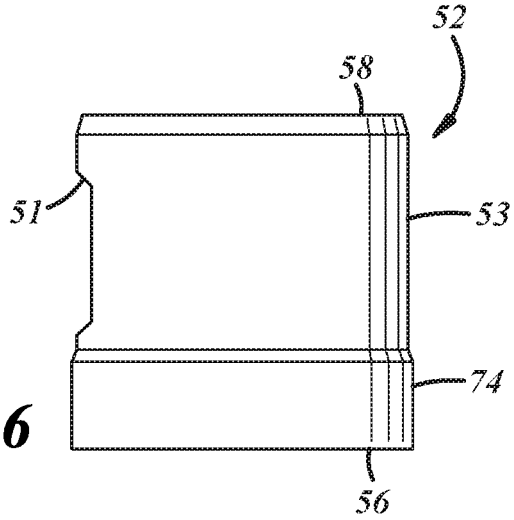
FIG. 6 is a side view of the valve body.
Figure 7:
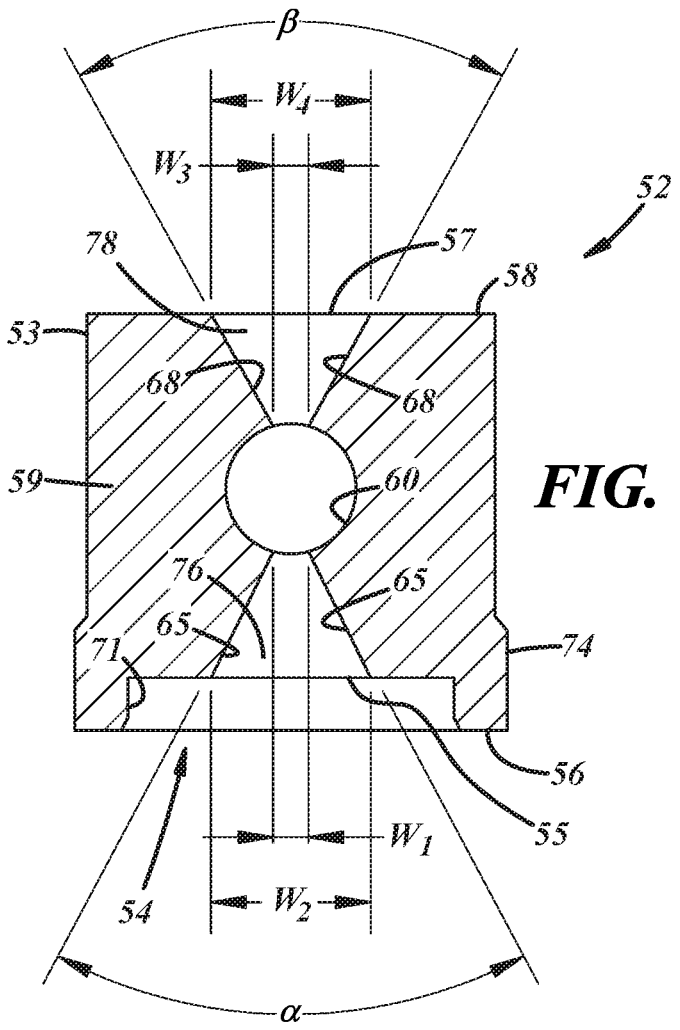
FIG. 7 is a cross-sectional view of the valve body taken along line 7-7 in FIG. 3.

In at least some implementations such as is shown in FIGS. 5 and 7, a first width W1 of the first portion of the valve passage 54 at the inlet 55 is greater than a second width W2 at the cross passage 60 is less than the diameter of the valve head 62. However, other widths, such as widths equal to or greater than the diameter of the valve head 62 may also be used. In the embodiment shown, a distance L1 between walls 67 of the first portion of the valve passages 54 may be the same at the cross passage 60 as at the inlet 55. In other embodiments, the distance L1 may vary along the axial length of the first portion of the valve passage 54. And in at least some implementations, the second width W2 of the second portion of the valve passage 54 at the outlet 57 is less than the diameter of the valve head 62.

Figure 3:
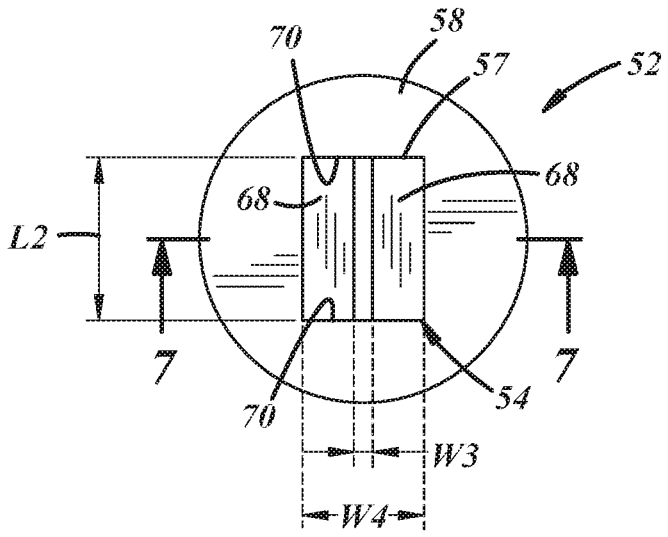
FIG. 3 is a top view of a valve body of the flow control valve.
Figure 4:
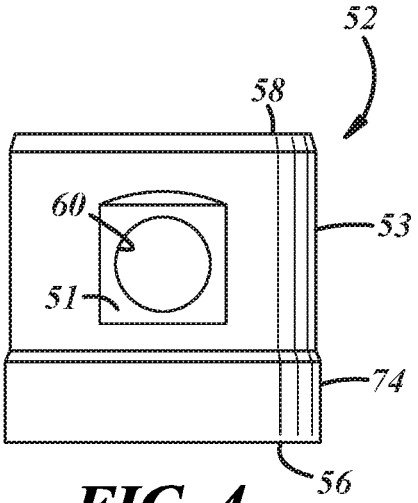
FIG. 4 is a front view of the valve body.

In at least some implementations, such as shown in FIGS. 3 and 7, the second portion of the valve passage 54 is defined by portions of the sidewall 59 of the valve body 52, where the portions extend between the outlet 57 and the cross passage 60. A first pair of walls 68 are on opposite sides of the valve passage 54 and are angled away from each other (e.g., forming an acute angle relative to one another) from the cross passage 60 to the outlet 57. A second pair 70 of opposed walls are substantially parallel (i.e., within plus or minus five degrees of parallel) to one another and define opposite sides of the second portion. However, it is appreciated that other valve passage 54 shapes (e.g., cylindrical, conical, quadrilateral prism, etc.) and other wall angles may also be used. For example, some embodiments may include one or more curved walls, the same flow area throughout the second portion of the valve passage 54 or the flow area may change in a different manner, and while the walls 68 are shown as being inclined at an angle $\beta$ (FIG. 7) of about 60 degrees, other embodiments may have walls at angles between 45 and 75 degrees.

In at least some implementations, a first width W3 of the second portion of the valve passage 54 at the cross passage 60 is less than the diameter of the valve head 62. However, other widths, such as widths equal to or greater than the diameter of the valve head 62 may also be used. In the embodiment shown, a distance L2 between walls 70 of the second portion of the valve passages 54 the same at the cross passage 60 as at the outlet. In other embodiments, the distance L2 may vary along the axial length of the second portion of the valve passage 54. And in at least some implementations, a second width W4 of the second portion of the valve passage 54 at the outlet 57 is greater than the diameter of the valve head 62.

The valve body may include a recess 71 may be substantially cylindrical and include an orientation feature shown as a straight edge 72. The straight edge 72 may be used to help orient the flow control valve 46 during assembly of the flow control valve 46 for example, to ensure alignment of the cross passage 60 with the carburetor bore 66. Additionally, the straight edge 72 may help to orient another part (e.g. an insert 75—FIG. 2) that is received partially within the recess 71 and which may axially locate the valve body 52 in a desired position within the fuel passage 26. In some embodiments, there may be additional recesses or protrusions surrounding the valve passage inlet 55, and in yet other embodiments, there may not be any recesses or protrusions around the valve passage inlet.

The valve body 52 may include a radially outwardly extending and circumferentially continuous rim or flange 74 that may be sized for an interference or press-fit into the fuel passage 26. This may provide a seal between the valve body 52 and carburetor body to prevent fuel from flowing around the valve body 52 rather than through the valve passage 54.

Additionally, the flange 74 may assist in orienting the valve body 52 during assembly and maintaining the position of the valve body 52 relative to the carburetor body 12 in use. Of course, the flange 74 is not required and other sealing and retention features or components may be used or none at all, if desired.

While a single valve passage 54 is shown, in other embodiments, there may be multiple valve passages, the valve passages may include separate inlets and outlets or some or all of multiple inlets may converge into a fewer number of outlets (including one), or one or more inlets may diverge to multiple outlets. In one embodiment, the valve passage 54 may be considered two valve passages with a first valve passage 76 including or being defined by the first portion of the valve passage extending from the inlet 55 to the cross passage, and a second valve passage 78 being defined by the second portion of the valve passage extending from the cross passage 60 to the outlet 57 and from which fuel exits the flow control valve 46 and enters the main bore 14.

The flow control valve 46 is used to calibrate a maximum flow rate of fuel to the main bore 14 during normal operation of the vehicle engine. Because of tolerances and variances in parts within a production run, one carburetor as manufactured does not have the same dimensions and fuel flow characteristics as the next. Therefore, the flow control valve 46 is calibrated after assembly of the carburetor 10 to provide the desired maximum fuel flow rate by adjusting the position of the valve head 62 relative to the valve body 52, thereby changing the effective or open flow area of the valve passage 54. Once the valve head 62 is in its desired position, it doesn't move in use (although it may be adjusted or recalibrated after the initial calibration). The actual flow rate of the fuel through the valve passage 54 is then controlled by the throttle valve 15 which rotates in the main bore 14 to change the flow rate of air and the flow rate of fuel in the carburetor 10, as noted above.

In at least some implementations, the first valve passage 76 may be aligned with the second valve passage 78, and fuel may flow generally linearly through the valve passage 54 from the inlet 55 to the outlet 57. In at least some implementations, a straight line may be drawn within the valve passage 54 from the inlet 55 to the outlet 57 without the line touching the valve body 52. The valve passage may be arranged parallel to the axis of rotation 36 of the throttle valve 15 or at any other desired angle. Further, the fuel passage 26 may be linear between the fuel chamber 22 and the main bore 14. In at least some implementations, a straight line that extends from the fuel chamber to the main bore 14 may be drawn within the fuel passage without the line touching the intermediate body 16 or main body 12. In some implementations, a straight line that extends from the fuel chamber to the main bore 14 may be drawn within the fuel passage without the line touching the intermediate body 16, the main body 12 or the valve body 52 (i.e. the line extends through the valve passage 54). In some implementations, fuel may flow generally linearly between the fuel chamber and the fuel nozzle 42 without having to navigate turns and corners formed between adjacent portions of a fuel passage that are not aligned. The fuel passage 26 and the valve passage 54 may be aligned with the fuel nozzle 42 and all of these components or features may axially aligned with the axis of rotation of the throttle valve 36, in at least some implementations. The valve passage may be aligned with the fuel nozzle such that a straight line may be drawn from the inlet of the valve passage, through the outlet of the valve passage and to a passage through the fuel nozzle. The linear fuel flow path permits the fuel to flow through a shorter path than if the passage included bends or angled portions so that the fuel flow is more responsive to changes in engine fuel demand, and so that fuel vapor and air are less likely to collect against corners or other discontinuous and angled surfaces in a fuel passage. In at least some implementations, at least part of the fuel passage extends from the valve passage to the main bore without including a turn or deviation from a straight path by more than 20 degrees, measured from a center of the fuel passage, and in some instances, without a turn or deviation from a straight path by more than 10 degrees.

Prior carburetors included fuel passages that were not linear between the metering assembly fuel chamber and the main bore. Thus, fuel had to change direction as it flowed through various angled portions of the fuel passage between the fuel chamber and the main bore, and the fuel had to navigate turns and flow past corners in the fuel passage. This circuitous fuel path generated more vapor from the fuel and the corners and other surfaces that confront or are opposed to fuel flow (e.g. perpendicular to fuel flow) tended to generate vapor and permit vapor to collect into larger bubbles that when released into the fuel flow would reduce the volume of liquid fuel delivered from the carburetor and negatively affect engine performance in at least some operating conditions. The circuitous fuel path may also be longer than a linear path which may affect the responsiveness of the fuel system to changes in engine fuel demand.

Further, the valve passage 54 at the inlet 55 may be larger than or the same size as the cross-sectional area of the fuel passage 26 upstream of the valve passage 54 (i.e. between the fuel chamber 22 and the valve body 52). The valve body 52 may be arranged so this the sidewall 59 does not extend radially inwardly into the fuel passage. In the implementation shown, the insert or component 75 has a through passage that is aligned with the valve passage inlet 55 and the through passage has a flow area that is equal to or smaller than the flow area of the inlet 55. Also, the outlet 57 of the fuel passage may be aligned with an inlet of the main fuel nozzle 42, and the valve body second end 58 may be arranged so that there is not a radially inward step (e.g. surface perpendicular to the valve passage 54 and extending inwardly) between the valve body 52 and the main fuel nozzle 42. This may provide a smoother, more continuous fuel passage with limited or no inwardly extending surfaces confronting or perpendicular to the direction of fuel flow, to reduce the surfaces against which fuel vapor may collect. This may also reduce the number of surfaces against which fuel flow is interrupted and hence becomes more turbulent which may cause additional vapor to form.

The forms of the invention herein disclosed constitute presently preferred embodiments and many other forms and embodiments are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A charge forming device, comprising:

a body having a main bore through which air flows and having at least one fuel inlet;

a diaphragm coupled to the body;

a fuel metering assembly including a fuel chamber defined in part by the diaphragm, the fuel chamber having an outlet;

a fuel passage extending from the outlet to the main bore;

a valve body received in the fuel passage, the valve body having a first end, a second end aligned with the first end, a sidewall extending between the first and second ends, a valve passage having an inlet into which fuel from the fuel chamber enters the valve passage and an outlet from which fuel exits from the valve passage for delivery to the main bore, and a cross passage extending through the sidewall between the first end and the second end and opening into the valve passage; and a valve carried by the body and having a valve head received in the cross passage and extending into the valve passage to at least partially inhibit fuel flow through the valve passage, and wherein the valve head is movable relative to the valve body to vary the flow rate of fuel discharged from the valve body.

2. The device of claim 1 wherein the fuel passage is linear.

3. The device of claim 1 wherein the valve passage is arranged so that a straight line may be drawn within the valve passage between the first end and the second end without intersecting a portion of the valve body.

4. The device of claim 1 wherein a flow area of the valve passage decreases continuously from the first end to the cross passage.

5. The device of claim 1 wherein a flow area of the valve passage decreases continuously from the second end to the cross passage.

6. The device of claim 1 wherein fluid flows through the valve passage from the first end to the second end, a flow area of the valve passage decreases from the first end to the cross passage, and the flow area of the valve passage increases from the cross passage to the second end.

7. The device of claim 1 wherein a minimum flow area of the valve passage is defined between the valve head and the valve body.

8. The device of claim 1 wherein the cross passage includes an entrance that extends through the sidewall, and wherein the valve body includes a cavity aligned with and facing the cross passage, and the cavity is diametrically opposed to the entrance of the cross passage.

9. The device of claim 1 wherein the cross passage is perpendicular to the direction of fuel flow through the valve passage.

10. The device of claim 1 wherein the body also includes a valve bore that intersects the main bore, and wherein a throttle valve is rotatably received at least partially within the valve bore and includes a valve passage through which air from the main bore may flow.

11. The device of claim 1 which also includes a fuel nozzle in communication with or defining part of the fuel passage and through which fuel is discharged into the main bore, and wherein the valve passage is aligned with the fuel nozzle such that a straight line may be drawn from the inlet of the valve passage, through the outlet of the valve passage and to a passage through the fuel nozzle.

12. A device for controlling fluid flow, comprising:

a valve body having a first end, a second end and a sidewall extending between the first end and the second end;

a valve passage extending through the body from the first end to the second end such that a straight line may be drawn within the valve passage between the first end and the second end;

a cross passage extending through the sidewall between the first end and the second end and intersecting the valve passage; and a valve head received in the cross passage and having a periphery, and a flow path through which fluid flows is defined between the peripherry of the valve head and the valve body.

13. The device of claim 12 wherein a flow area of the valve passage decreases from the first end to the cross passage.

14. The device of claim 12 wherein a flow area of the valve passage decreases from the second end to the cross passage.

15. The device of claim 12 wherein fluid flows through the valve passage from the first end to the second end, a flow area of the valve passage decreases from the first end to the cross passage, and the flow area of the valve passage increases from the cross passage to the second end.

16. The device of claim 15 wherein a minimum flow area of the valve passage is defined between part of the valve head and the valve body.

17. The device of claim 12 wherein a minimum flow area of the valve passage is defined between part of the valve head and the valve body.

18. The device of claim 17 wherein the cross passage includes an entrance that extends through the sidewall, and wherein the valve body includes a cavity aligned with and facing the cross passage, and the cavity is diametrically opposed to the entrance of the cross passage.

19. The device of claim 17 wherein the cross passage is perpendicular to the direction of fuel flow through the valve passage.

* * * * *